United States Patent [19]

Akesson et al.

[11] Patent Number: 4,750,621

[45] Date of Patent: Jun. 14, 1988

[54] APPARATUS FOR SORTING CUTLERY

[75] Inventors: Lars Akesson, Åkersberga; Nils Lööf, Järfälla, both of Sweden

[73] Assignee: Regionala Stiftenlsen i Varmland med firma ERRESS, Hagfors, Sweden

[21] Appl. No.: 19,559

[22] PCT Filed: May 9, 1986

[86] PCT No.: PCT/SE86/00217

§ 371 Date: Jan. 21, 1987

§ 102(e) Date: Jan. 21, 1987

[87] PCT Pub. No.: WO86/06661

PCT Pub. Date: Nov. 20, 1986

[30] Foreign Application Priority Data

May 14, 1985 [SE] Sweden ..... 8502382

[51] Int. Cl.[4] ..... B07B 13/05

[52] U.S. Cl. ..... 209/539; 209/540; 209/926

[58] Field of Search ..... 209/509, 536, 539, 540, 209/576, 926

[56] References Cited

U.S. PATENT DOCUMENTS

| | | | |
|---|---|---|---|
| 4,380,294 | 4/1983 | Morris | 209/540 |
| 4,457,434 | 7/1984 | Brown et al. | 209/539 |
| 4,511,046 | 4/1985 | Walsh et al. | 209/539 |
| 4,585,126 | 4/1986 | Paddock et al. | 209/539 |

FOREIGN PATENT DOCUMENTS

| | | |
|---|---|---|
| 0007248 | 7/1979 | European Pat. Off. . |
| 0020108 | 5/1980 | European Pat. Off. . |
| 384974 | 5/1976 | Sweden . |
| 405214 | 11/1978 | Sweden . |
| 409251 | 8/1979 | Sweden . |
| 414543 | 8/1980 | Sweden . |

*Primary Examiner*—Joseph F. Peters, Jr.

*Assistant Examiner*—Stephen P. Avila

*Attorney, Agent, or Firm*—Murray and Whisenhunt

[57] ABSTRACT

The invention relates to a method of sorting cutlery, comprising opto-electronic dynamic recognition and identification of the cutlery. The pieces of cutlery are brought forward in a longitudinal direction one by one behind each other on a moving conveyor belt (12). The movement of the belt is precision linked to a pulsator (13), which emits pulses with a frequency that is directly proportional to the speed of the belt. The pieces of cutlery are brought by the conveyor belt to pass one by one through an optical read-off unit (14) between a light source (32) and a bar (40) of photo-transistors (33) or light-conductors (38) which transmit light to photo-transistors. The bar extends at right angles to the direction of movement of the belt, so that it is partially shaded by the cutlery when this passes, whereupon the photo-transistors in the parts of the bar shaded at any moment are inactivated. At a moment of time which is controlled by the pulsator the standstill of activation is recognized for all photo-transistors in the bar. The standstill of activation for at least certain selected moments of time, representing a corresponding number of optical sections of the cutlery, is communicated to a computer (6) in the form of binary words, which each represent the width of the cutlery in the present section and which together with any further data form a digital signalization of the cutlery. This signalization is scanned with regard to a number of digital signalizations of the different pieces of cutlery that are to be sorted which have been previously programmed in the computer's memory unit. With accord between the scanned one and any of the programmed cutlery signalizations the cutlery is guided to a box (24A-D) corresponding to this type of cutlery or correspondingly. The invention also concerns the apparatus for the execution of the method.

11 Claims, 8 Drawing Sheets

Fig.8A.
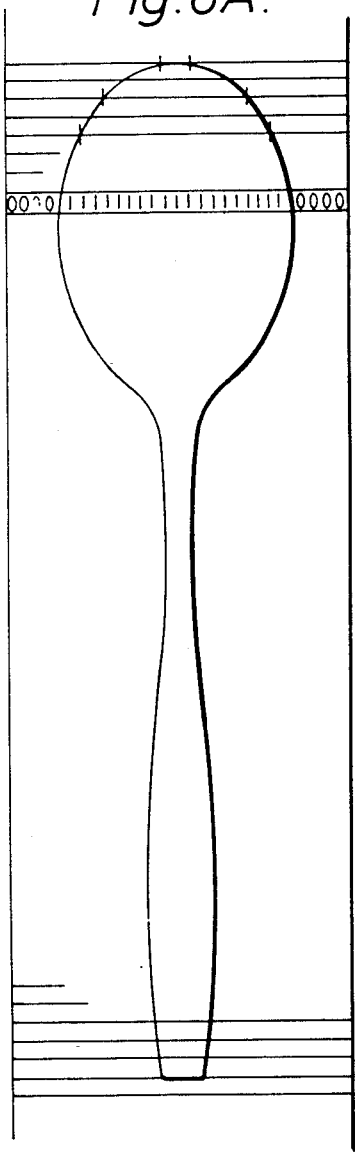
Fig.8B.
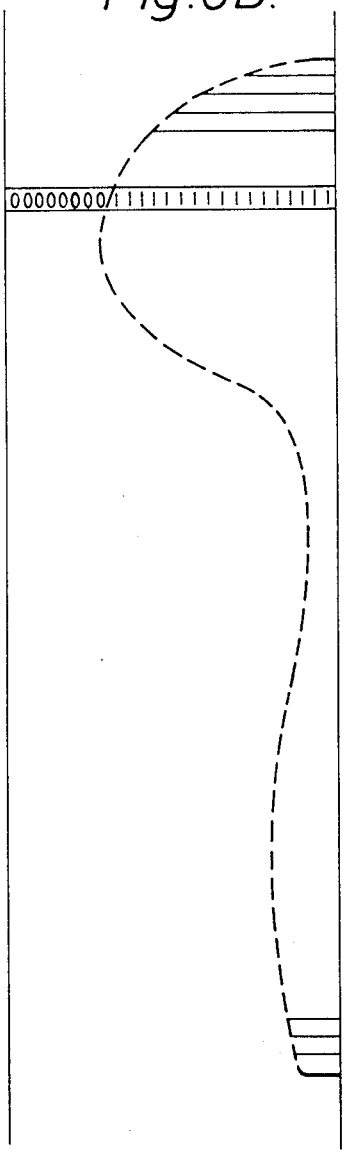
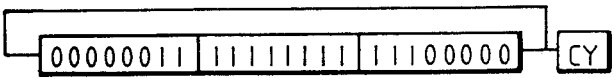
Fig.9A.
Fig.9B.
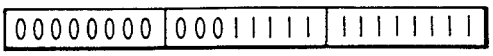

APPARATUS FOR SORTING CUTLERY

TECHNICAL FIELD

The invention relates to an apparatus for sorting cutlery comprising opto-electronic recognition and identification of the cutlery.

BACKGROUND ART

A large numver of different systems for automatic sorting of cutlery after machine washing in large kitchens have been suggested. With systems already known the cutlery has for example been sorted by weight as per U.S. Pat. Nos. 3,331,507, 3,483,877 and 3,581,750, through mechanical recognition in holes, slots etc., as per U.S. Pat. Nos. 3,301,397, 3,389,790, 3,389,791, 3,545,613 and 3,956,109, or through detection of the cutlery's magnetic properties in electro-magnetic fields as per U.S. Pat. Nos. 3,394,809 and 3,486,939. These weight-recognising, mechanically or electro-magnetically working recognition systems are, however, either complicated, slow, expensive and/or unreliable or have other disadvantages. As far as is known they have therefore not been of any practical significance.

Another known procedure is to detect objects dynamically through optical recognition, as for example through U.S. Pat. No. 3,529,169 and EP-A1-20 108. The systems described in these patent specifications, are, however, unsuitable for sorting of cutlery and suchlike objects.

SUMMARY OF THE INVENTION

The invention aims to offer an improved system for sorting of cutlery comprising opto-electronic, dynamic recognition of the cutlery. This and other objects of the invention can be achieved by means of this being characterised by what follows from the patent claims below. Further characteristics and aspects of the invention follow from the description below of a preferred, specific example of its embodiment.

BRIEF DESCRIPTION OF DRAWINGS

In the following description of a specific example, which at the same time constitutes a preferred embodiment of the invention, reference will be made to the enclosed drawings, in which FIG. 1 schematically illustrates the basic features of the invention in a view from above, partly in the form of block diagrams and symbolically illustrated components;

FIG. 8A illustrates the opto-electronic-digital scanning of the contours of the cutlery;

FIG. 8B shows the same cutlery in distorted form after shifting of the binary words originally obtained with the scan;

FIGS. 9A and 9B show a binary word before and after the said shifting

DESCRIPTION OF AN EXAMPLE OF EMBODIMENT

General construction of the system

Figure 1:
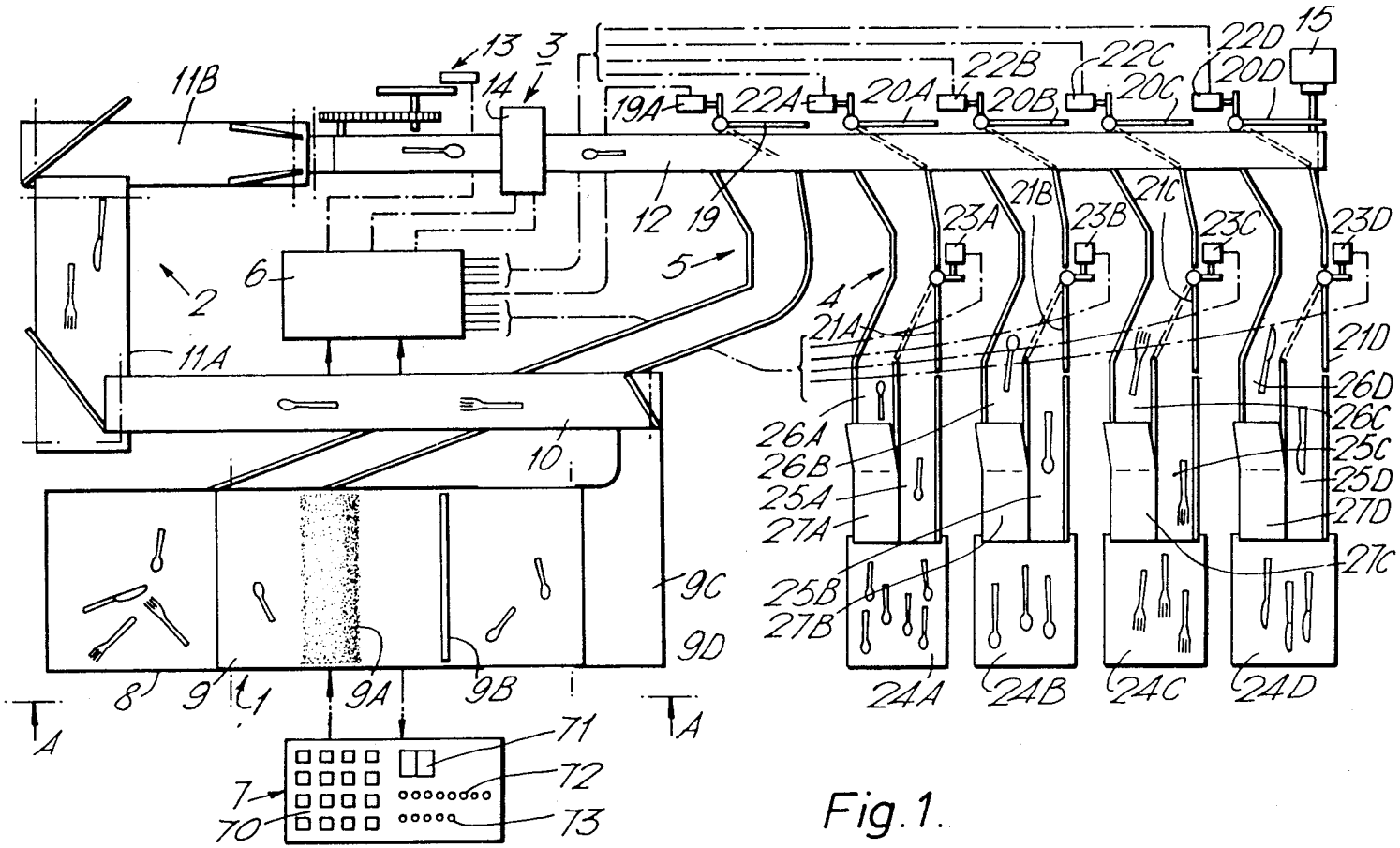
FIG. 1A shows separating units forming part of the equipment in a side view of A—A in FIG. 1.
Figure 1A:
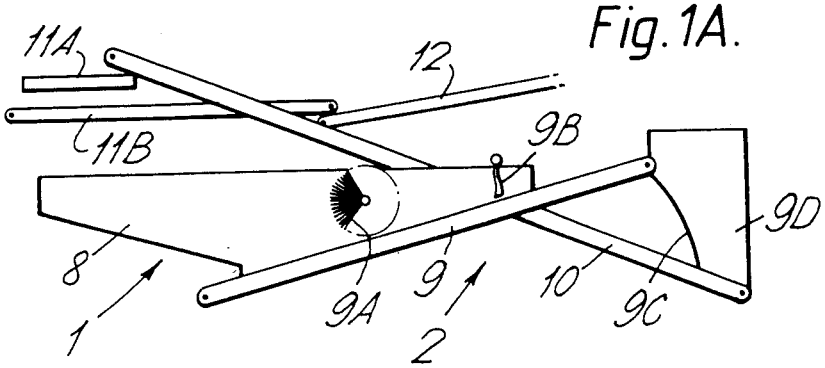

FIG. 1 shows schematically the general construction of an installation for sorting of cutlery—teaspoons, dessert spoons, knives and forks—after machine washign in a large kitchen. The equipment consist of five function units; a feed-in unit 1, a separating unit 2, a read-off unit 3, a sorting unit 4 and a return unit 5. These five units should, however, not be considered as independently working units. A characteristic feature is rather that they both constructionally and functionally work together and "integrate with each other". The equipment is controlled and monitored by a microcomputer 6. The control system can be directed from outside with a control unit 7.

The feed-in and separating units

The feed-in unit 1 consists of a box 8, into which the washed and dry cutlery is poured. The bottom of box 8 slopes down towards an upwards feed device 9, which consists of a first endless belt and which, at the same time as it functions as an upwards feed device, constitutes the first separation element in the separating unit. The belt 1 slopes upwards and on this first separation belt the cutlery is roughly separated with the aid of a rotating brush 9A and a flexible screen 9B. At the upper end of the belt 9 there is a chute 9C with a curved outer wall 9D. The chute 9C slopes down towards the lower end of another endless conveyor belt 10. At the uppe end of this there is a third conveyor belt 11A, which is at right angles to belt 10. After belt 11A there follows a further belt 11B, which is horizontal like belt 11A, and finally there follows a fifth conveyor belt 12, which slopes slightly upwards. Through this arrangement the following separation effects are obtained. Through this arrangement the following separation effects are obtained. As the cutlery is fed upwards out of the container 8 on the first belt 9 the brush 9A which rotates in the opposite direction spreads out the cutlery on the belt 9. A similar effect is also given by the flexible screen 9B which is divided into strips. When the cutlery falls from belt 9 on the chute 9C a separation effect also occurs through a difference of level existing between the upper end of the belt 9 and the chute 9C. Furthermore a separation effect occurs through the fact that the belt 10 is at right angles to the chute 9C, and in actual fact this comprises a 180° change of direction in relation to belt 9. Each such change of angle has as a result that the pieces of cutlery tend to slide apart from each other. This effect is also obtained with the change between belts 10 and 11A, and in this case too there is a difference in level which also gives a separation effect. This correspondingly has an effect at the change between belts 11A and 11B. But the predominant separation effect takes place through the difference in speed among the five belts. A subsequent belt namely always has a higher speed than the belt immediately preceding it.

The separating unit 2 consists of two belts 10, 11, which are driven at different speeds by separate motors, which are not shown. Through the difference in speed there is a further separation of the cutlery, which is now fed forwards in a longitudinal direction.

The read-off unit

Figure 2:
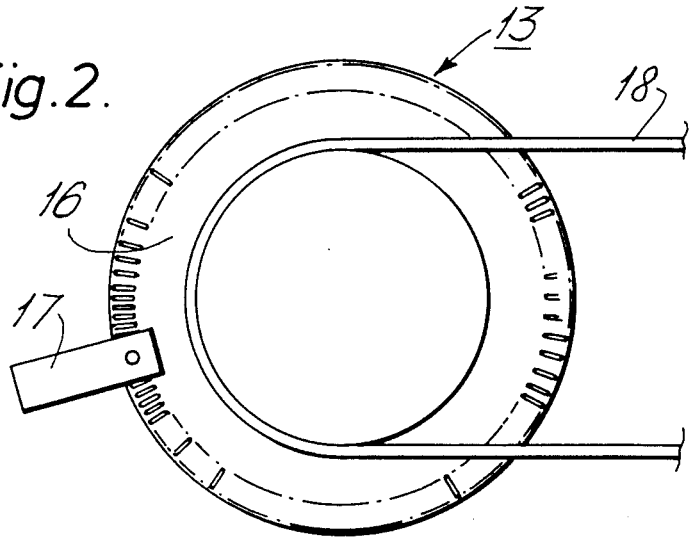
FIG. 2 schematically shows a pulsator forming part of the equipment.

The read-off unit consists of the conveyor belt 12, a pulsator 13 and an optical unit 14. The separation unit 2 delivers the pieces of cutlery singly to a comparatively narrow conveyor belt 12. By "comparatively narrow" it is understood that the belt 12 is much narrower than the length of the smallest piece of cutlery—the teaspoon. It should also be noticed that the belt 12 has edge plates at the sides, which are not shown in the figure, and that it is the width between these edge plates which constitutes the effective "comparatively narrow" width of the conveyor belt 12. The belt 12 is driven by a motor 15. The pulsator 13, FIG. 2, is made up of a unit which is in itself well known and consists of a sector disc 16 and a reading fork 17. The disc 16 is mechanically synchronised with the conveyor belt 12 through drive via toothed driving wheels and a toothed belt 18. The reading fork 17, consisting of photo-transistors and photodiodes, generates pulses at each shading or relighting of the sector disc 16. The pulse frequency is in direct proportion to the speed of the conveyor belt 12. The pulse width, i.e. the width between similar levels for each link unit, represents a distance or a length. The optical unit 14 and the parts of the conveyor belt 12 belonging to it will be described more thoroughly below.

The sorting unit

The sorting unit 4 comprises four flaps 20A–D and four switchpoints 21A-D. The flaps are manoeuvred by electro-magnets 22A–D and the switchpoints by electro-magnets 23A–D. The flaps push the cutlery off the conveyor belt 12, so that it lands in the right cutlery compartments or boxes 24A–D. The computer programme sees to which flap is to be moved at the right moment. If the cutlery is the right way round, which in this case has been noted in the optical unit 14 and the microcomputer, the cutlery slides down into one of the upper cutlery boxes 24A, 24B, 24C or 24D (each tupe of cutlery has two cutlery boxes 24A–D placed one above the other) via the right-hand one of the two sloping chutes which are to be found in each sorting group. Slideways or chutes have been designated 25A–D. If on the other hand the cutlery is the wrong way round, which in this case has also been noted in the said recognition units, the corresponding switchpoint 21A–D and the corresponding electro-magnet 23A–D are moved, so that the cutlery is instead directed into the left-hand chute 26A, 26B, 26C or 26D, so that it will pass one of the turning devices 27A–D, before it lands, turned the right way, in the correct box in the lower row of cutlery boxes. When the boxes are full, this is indicated on a control unit, after which they are changed manually or automatically.

Besides the four sorting flaps 20A–D there is also a reject flap 19, which is situated in front of the sorting flaps. The reject flap 19 is manoeuvred by an electro-magnet 19A in order to return unprogrammed, i.e. unidentified objects and in certain situations also return appropriate cutlery to the box 8 via a chute 19B, and especially to return pieces of cutlery which have not been separated from each other effectively by the separating unit but are fed forward so that they overlap each other on the conveyor belt 12. Such overlapping cutlery cannot be identified by the read-off unit and is returned therefore to the box 8 via the chute 19B.

Figure 10:
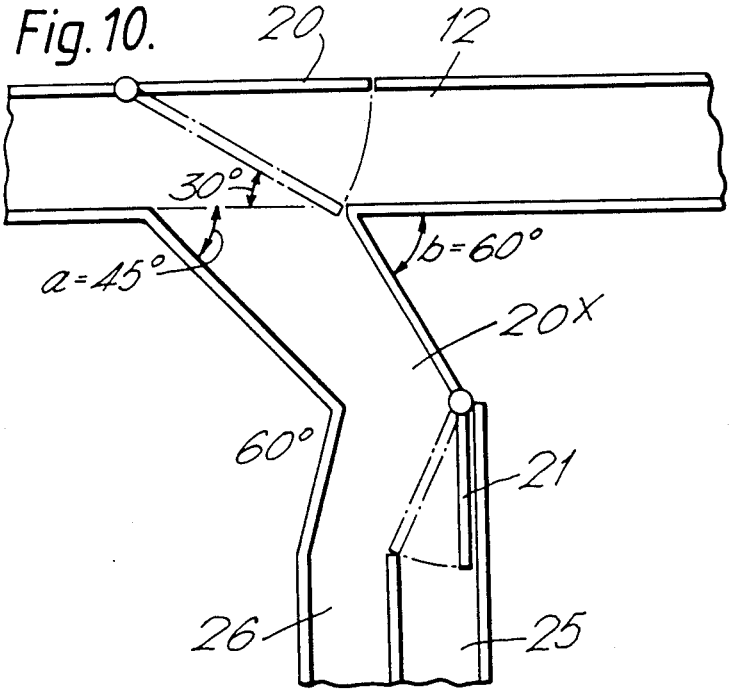
FIG. 10 constitutes a plan view which shows in greater detail the arrangement of flaps and switchpoints in a sorting unit forming part of the equipment.

In the sorting of the cutlery from the conveyor belt 12 certain problems may arise if the equipment is not correctly shaped. For example problems arise if the flaps 20A–D do not manage to change, if the cutlery becomes wedged or if the flaps were unsuitably placed. It has shown itself advisable to shape the equipment so that the vertical axis of rotation of each flap 20A–D meets the cutlery, as becomes clear from FIG. 10, which shows one of the sorting units. The switchpoints too, like the switchpoint whichis designated 21 in FIG. 10, are arranged so that they meet the cutlery with the end in which the vertical axis of rotation is set. The switchpoint 21 is further so arranged that in the normal position it keeps both the right-hand one and the left-hand one of the two sloping chutes 25 and 26 open towards the upper and lower sorting boxes respectively. The cutlery is directed in this case by the flap 20 and the chute 20X set obliquely in relation to the conveyor belt 12 towards the right-hand chute 25. When the switchpoint 21 goes over through rotation of the switchpoint about its axis of rotation, channel 25 to the upper box is closed and instead the cutlery is sent at an angle towards the left-hand channel 26. Through the fact that the axis of rotation of the switchpoint 21 points towards the direction of flow of the cutlery, the switchpoint can thus move the cutlery over into the correct chute while it is in motion. In the choice of the shape of the chute 20X account has had to be taken of, among other things, the length of the cutlery, so that it can be turned, i.e. change direction while in motion without being wedged tight or getting stuck crossways. For this reason angle a must be greater than angle b, which in its turn entails that the channel 20X narrows down towards the switchpoint 21. It has proved advisable for angle a to be about 45°, angle b about 60°, while the slope of the flap 20 towards the conveyor belt 12 should preferably be about 30°. Thus the flap 20, the right-hand wall of chute 20 and slideway 20X and the switchpoint 21 form an acceptably even control are for the cutlery. Both the flaps, the switchpoints and the control areas can, however, be made curved.

Figure 11:
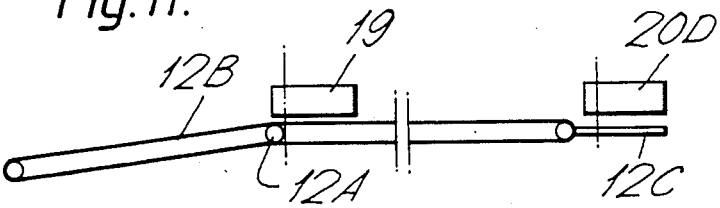
FIG. 11 schematically illustrates in a side view how knife blades and other thin parts can be prevented from being wedged tight between flap and conveyor belt.

Another problem that can arise with sorting devices of this kind is that the knife blades wedge tight under the reject flap 19 or under the flap 20D, which is referred for sorting of knives. This problem can, however, be eliminated if the equipment is shaped in the way schematically illustrated in FIG. 11. In this figure the reject flap 19 and the last sorting flap 20D are shown. The reject flap 19 is positioned immediately after an intermediate roller 12A, where the conveyor belt goes over from being upwards sloping to being quite level. As a knife is transported up the sloping section with the blade at the front, the blade will be lifted up from the belt when the knife passes the intermediate roller 12A. By this means the risk is eliminated of the knife blade being able to be wedged tight between the flap 19 and the belt 12 if the flap 19 moves. For the same reason the conveyor belt 12 terminates immediately before the concluding flap 20D. Instead the knives are guided out on to a slideway 12C, which is arranged on a slightly lower level than the upper surface of the belt 12. In this case too the effect is obtained that the knife blades, if the knives come with the blade at the front, will be located at a higher level than the base when the flap 20D moves, whereby in the desired manner it is avoided that the knife blades can be wedged tight under the flap 20D.

The optical unit

Figure 3:
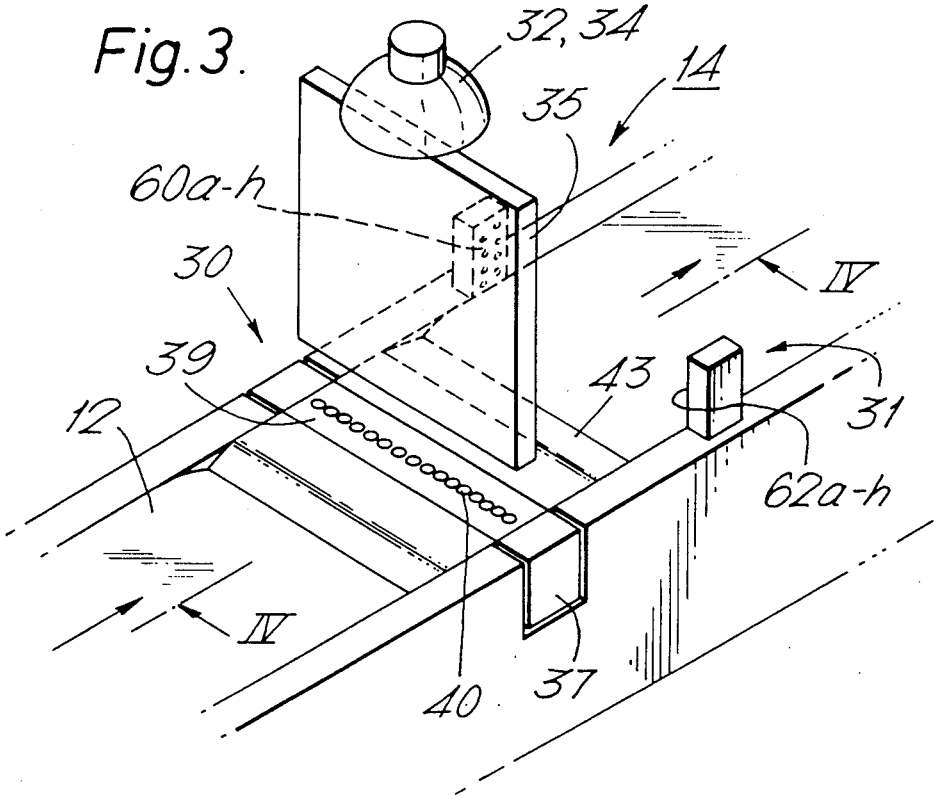
FIG. 3 shows the general construction of the optical unit in a perspective view.

FIG. 3 shows the general construction of the optical unit 14, which actually consists of two optical units, namely a unit for optical recognition of the contour of the cutlery when the cutlery is seen from above, and a unit for optical recognition of the cutlery from the side, more precisely its height in relation to the conveyor belt 12. These units are designated in the following text contour opto 30 and height opto 31 respectively. The recognition takes place dynamically, i.e. with the cutlery in motion relative to optical unit 14.

The contour opto

Elements of the contour opto include a common light source 32 and twenty-four photo-transistors 33, which are affected by the infra-red components in the light from the light source 32. The light source 32 consists of a halogen lamp 34 positioned over a light conductor consisting of a vertical glass plate 35, which points downwards. The glass plate is as wide as the belt 12.

Figure 4:
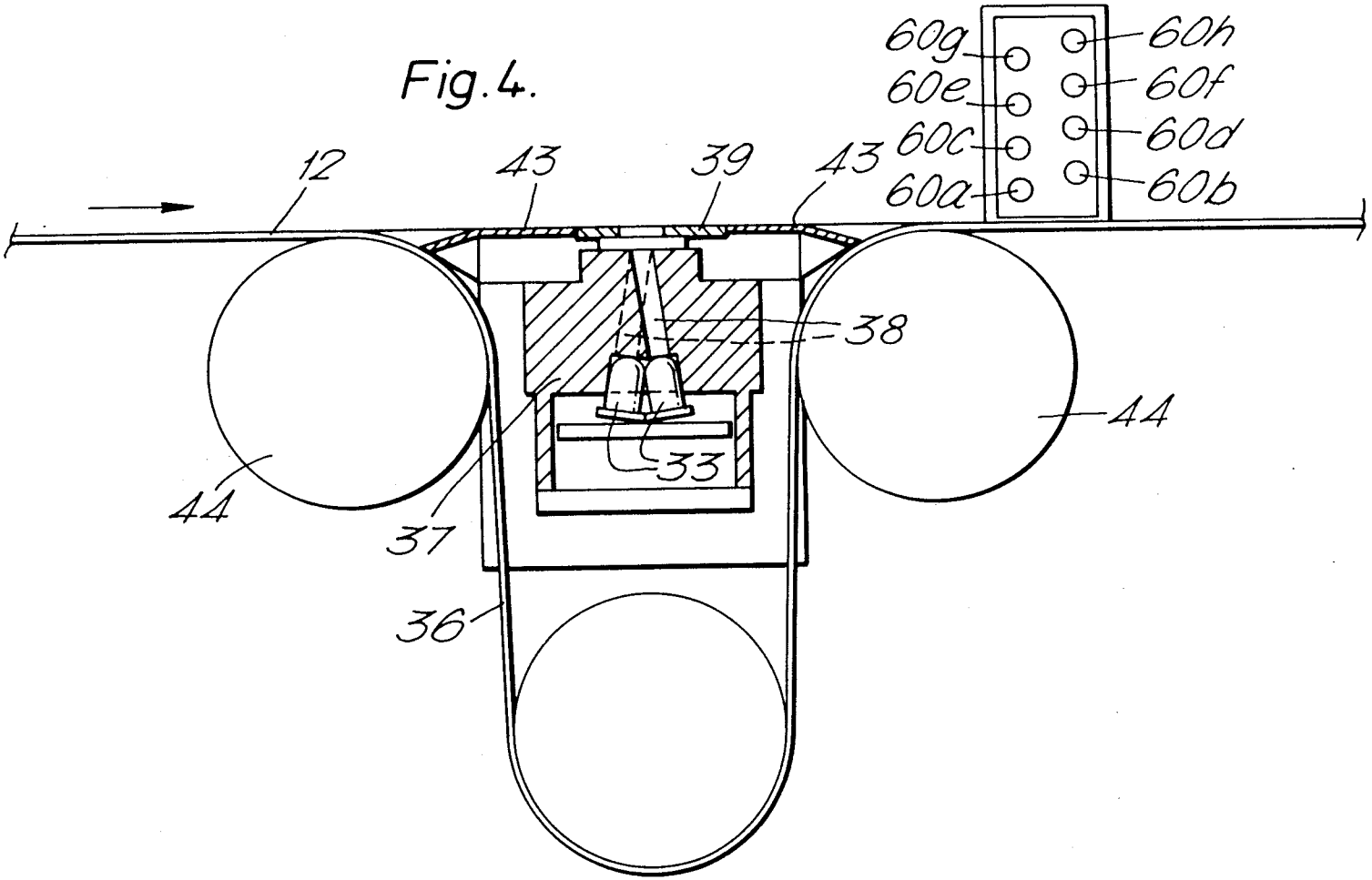
FIG. 4 shows parts of the optical unit shown in FIG. 3 in a vertical section IV—IV in FIG. 3.

In the area before the contour opto 30 the path of the conveyor belt 12 forms a U-shaped loop 36, FIG. 4. Within this loop 36 the photo-transistors 33 are located in container 37. They are positioned in zigzag fashion, so that they cover the width of the track, since their external dimensions do not allow them to be arranged in a row side by side if the desired separation—2 mm—is to be achieved. Instead each photo-transistor is provided with a light conductor 38 consisting of a channel bored out in the container 37. From orifices which form a single-row lighting bar 40 under a slot in a cover plate 39 the light conducting channels 38 extend obliquely downwards to the respective photo-transistors 33. The lighting bar 40 is at right angles to the direction of transport of the belt 12. Instead of light conducting channels 38 flexible plastic bars or optic fibres to the photo-transistors 33 can be used. Between the conveyor belt 12 and the cover plate 39 there are also situated bridging slide rails 43 on each side of the cover plate 39. A pair of intermediate wheels have been designated 44. The lighting bar 40 is covered by a transparent film. The distance between the intermediate wheels 44 is no greater than will allow even the shortest piece of cutlery that is to be detected, in this case a teaspoon, to be pushed and pulled over the loop 36 from the left-hand straight section of the conveyor belt 12 to its right-hand one.

Through the light bar 40 being placed transversely across the direction of movement of the conveyor belt 12, and through the fact that each light conductor 38 conducts light from the lighting bar 40 to one of the twenty-four photo-transistors 33 the same result is obtained as if the photo-transistors were packed together in a row with 2 mm separation.

Figure 5:
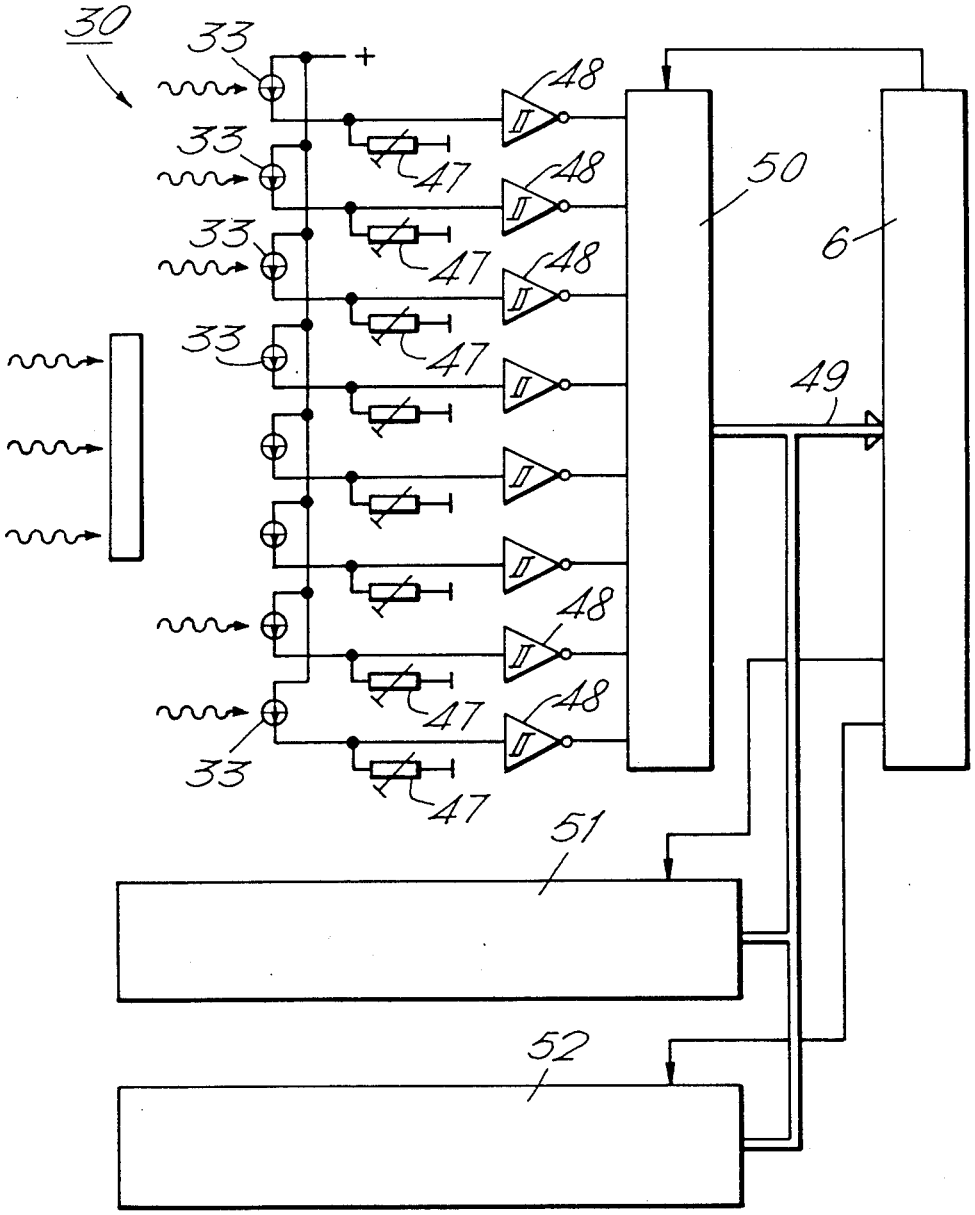
FIG. 5 shows an electronic unit for conversion of optically recognised information in the form of shadow pictures with vertical lighting of the cutlery in narrow optical sections into binary words, representing the contour of the cutlery.

The photo-transistors 33 are coupled in three groups or bytes with eight transistors in each byte, FIG. 5. The sensitivity of the photo-transistors ban be trimmed with trim potentiometers 47. At every pulse—called sync pulse below—which the pulsator 13 generates, all twenty-four photo-transistors are scanned. The photo-transistors which are lit up, as for example the three top ones and the two lower ones in the upper group in FIG. 5, give off after appropriate Schmitt triggers 48 a logic zero. The photo-transistors which are shaded cease to conduct and consequently give off logic ones after appropriate Schmitt triggers 48. Each byte is selected sequentially from the outside via microcomputer 6, which controls the three selectors 50, 51, 52. Together the three bytes which form part of the contour opto give an optical section of the object studied, or if you like a picture of a thin slice of the object studied from above in each moment given by the pulsator—called photo-opto sections below—of twenty-four bits.

Figure 7:
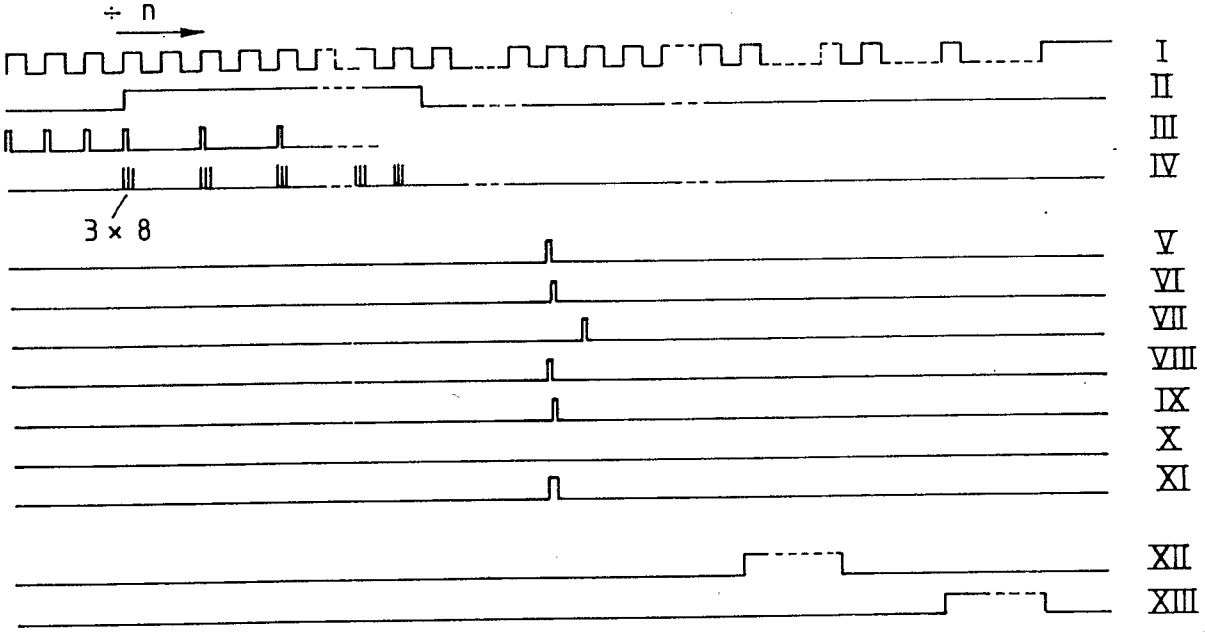
FIG. 7 constitutes a pulse diagram.

The sync pulses, row I in FIG. 7, generate an interrupt (scanning pulse, row III in FIG. 7) to the microcomputer 6. According to the programme of the microcomputer the photo-transistors 33 are arranged so taht with every interrupt they scan whether any object is shading the light conductor bar 40, which extends transversely over the conveyor belt. At the first interrupt, where any photo-transistor 33 or corresponding Schmitt trigger 48 gives off logic ones instead of logic zeros owing to the fact that any of the light conducting openings in the bar 40 is shaded, there begins the reading off of the object which is being fed forward by the conveyor belt 12 over the bar 40. From this point the opto section is read consecutively with the programmed separation of the sync pulses. This is illustrated graphically in row IV in FIG. 7. So that the scanning system may be able to react fast when an object, for example the tip of a spoon or knife, begins to shade the bar 40, the separation of the scanning pulses is closer before the first scan that gives a logic one. At each subsequent scanning pulse the opto section is read off, with each opto section being represented by a binary word, subsequently called opto section word. The objects scanned are so to speak shredded up into a number of slices, which are each represented by a contour opto section word. The opto section has accordng to the embodiment a separation of appr. 5 mm. Each logic one in the opto section word corresponds to a length unit and together the number of logic ones in the opto section word give a measure of the object's physical width in the opto section. This applies when no logic zeros occur between the logic ones in the opto section word. If the latter should be the case, the object scanned exhibits holes or spaces, as for example is the case with scanning of a fork.

However, the place of the cutlery on the belt can vary. Sometimes the cutlery lies in the middle, sometimes more towards one side or the other, depending on chance. So in their primary form the opto section words cannot be used for comparing with stored opto section words in the microcomputer's main memory.

Before the opto section words are stored in a computing memory in the microcomputer via the data bus 49, FIG. 5, all the opto section words are shifted, so that all objects scanned can be said to receive a common right-hand margin. Figuratively speaking the objects are pushed electronically to the right, at the same time as they are distorted, if the contour is curved, so that they receive a straight right-hand edge but unaltered width in each opto section. The shift occurs in such a way that the opto section words are shifted to the right (left is also imaginable). The shift continues with one data bit at a time according to known data technology and in accordance with the microcomputer's instructions, until you have a logic one as first bit, the first shading from one edge, i.e. furthest to the right in the opto section word.

The above described scanning and the shredding up of opto section words, the shift of the opto section words and the distortion of the object are illustrated in FIG. 8A and 8B and also 9A and 9B. The shift and the sequential storage of contour opto section words continues till no photo-transistor 33 any longer gives logic ones, i.e. till no photo-transistor 33 is shaded any longer, opto section n, FIG. 8A and 8B.

The height opto

Figure 6:
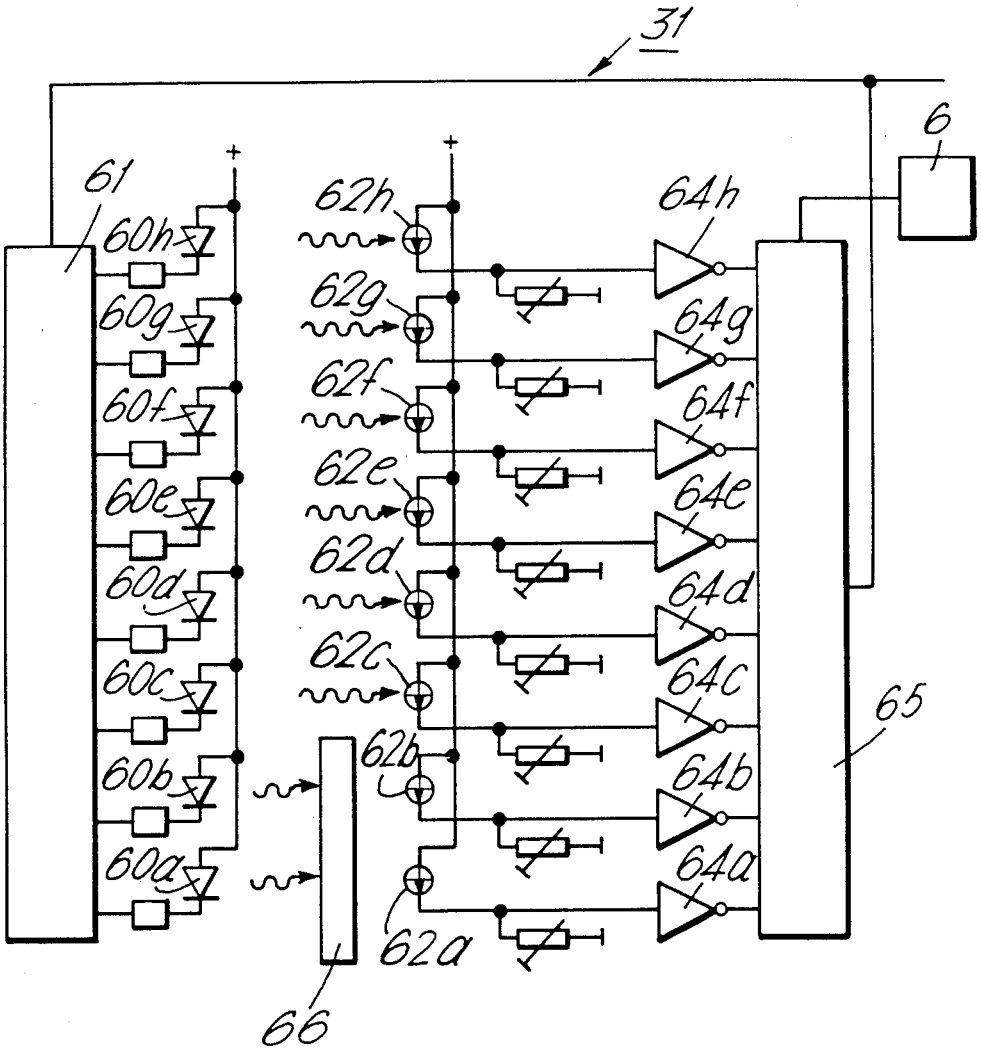
FIG. 6 shows in a corresponding manner an electronic unit for conversion of optically recognised information about the height profile of the cutlery into digital data.

In the height opto equipment 31, FIG. 3, FIG. 4 and FIG. 6, there is included on the one hand a driver 61, on the other a selector 65. Eight stacked photo-diodes are designated 60*a–h*. Via the driver 61 the photo-diodes 60*a–h* are driven sequentially beginning with the lowest photo-diode 60*a*. An object which is scanned is designated 66 in FIG. 6. To each photo-diode 60*a–h* corresponds a definite photo-transistor 62*a–h*. The photo-transistors 62*a–h* are stacked in the same way as the photo-diodes 60*a–h*, FIG. 4.

In the same sequence as the driver 61 is activated and the photo-diodes 60*a–h* give out a light pulse, the respective photo-transistors 62*a–h* are recognised, i.e. in time with the photo-diodes belonging to each photo-transistor emitting light. Through this the false influencing of photo-transistors through the spread of light is prevented. Depending on the light path between the photo-diodes and the photo-transistors, which are arranged each on their own side of the conveyor belt 12, such as for example the light path between the photo-diode 60*a* and the photo-transistor 62*a* or between the photo-diode 60*f* and the photo-transistor 62*f*, the scanned object is shut off or not, and either logic ones or logic zeros are obtained after the Schmitt triggers 64*a–h*, so that a height opto section word is obtained, which is communicated via a selector 65 and a data bus 67 to the microcomputer 6, where the word is stored without shifting till further notice. The selector 65 is controlled from the microcomputer 6. the reading off of the height opto 31 is clarified in the pulse diagram, FIG. 7, rows V–XI. It is assumed that the time scale for these pulse graphs is considerably smaller than the remaining pulse graphs in the diagram. The pushing towards the right depends on the fact that the height opto 31 is positioned at a distance after the contour opto 30, FIG. 3 and FIG. 4. A certain number of sync pulses after the first scanning pulse that gave logic ones in the contour opto's scanning, row III, the photo-diodes 60*a–h* emit light sequentially. It is assumed that only the two lower photo-transistors 62*a*, 62*b* are shaded by the object in the section scanned. The summing of the two pulses gives a measure of the height of the object in the present vertical section, row XI.

Manoeuvre unit and programming of signal elements

The manoeuvre unit 7, FIG. 1, contains a keyboard 70 with ten figure buttons and letter buttons, a display panel with space for two figures or letters in lumnious script, a number of control light diodes 73, and eight light diodes 72, which represents a third of a contour opto section and a whole height opto section, together with the corresponding electronics.

With the keyboard 70 a selection is made whether programming of objects is to happen, through the fact that a certain command is given on the keyboard and also what code the present cutlery in the present situation has in the microcomputer's main memorym, for example the figure combination 10, if it is a question of a teaspoon which is lying with the front upwards. The spoon is subsequently laid on the conveyor belt 12 in the present manner, after which it is allowed to pass the opto unit 14. The display panel 71 gives an indication that the correct code has been ordered. After the programming the system is reset automatically for reading off a new object.

In the programming the contour and height profile of the spoon are read off by the contour opto 30 or the height opto 31. All the contour opto sections are stored after shifting in a read-in memory. Certain selected contour opto sections and height opto sections are stored in a computing memory. More precisely the height of the scanned object is stored after a definite number of sync pulses reckoned from the front edge of the object expressed in digital form. All the contour opto section words have their tolerance set according to a table which is stored in the programme. The tolerance setting is required owing to the fact that the separation between the photo-transistors is not zero and also that the cutlery may lie somewhat obliquely on the conveyor belt 12 and also is exposed to shakings etc. The tolerance setting involves a min. and a max. value for the binary words being stored in the main memory. The tolerance setting occurs with the selected contour opto section words and is stored in the main memory in the microcomputer. A total value for all contour opto section words is also stored, the number of opto sections that have been registered for the present cutlery, i.e. the length, the second and third opto section words reckoned from the first opto section word and also the second and third opto section words reckoned from the last opto section word. All data have tolerance set and are stored in the main memory.

In order to characterise the shape of a piece of cutlery—i.e. its signalisation—it is not necessary to use all the contour opto section words if for the signalising one has at one's disposal the number of opto sections, the sum of the contour opto section words and also certain data from the height opto. Therefore according to the embodiment only the second, the third and also the second and third from the end of the contour opto section words are selected and stored. The height opto 31 is activated only after a certain number of sync pulses from the front end of the object. This information which gives a measure of the height of the cutlery in the sections studied is sufficient to show whether a table knife has the point turned to the front or to the back. A table knife namely does not have such a marked contour that with the chosen contour opto selection it gives sufficient information for an adequate signalisation. For other cutlery, however, the contour opto 30 and corresponding electronics would be completely sufficient for programming and detecting of individualising signalisation.

In this way each object is programmed in its four different imaginable situations on the belt 12, i.e. the right way round forwards, the wrong way round forwards, the right way round backwards and the wrong way round backwards. Each such situation is represented by a code in a table in the computer's main memory, and each code, which is entered on the keyboard 70 before the programming, corresponds to certain flaps 20A–D and, where appropriate, to switchpoints 20A–D in the sorting unit 4, FIG. 1. The table has in clear text the following construction in principle.

TABLE 1

| Type of cutlery | Situation of the cutlery | Code | Flap | Number of sync pulses to flap | Switch-point |
|---|---|---|---|---|---|
| Teaspoon | Forwards-upwards | 10 | 20A | $n_a$ | — |
| " | Forwards-downwards | 11 | 20A | $n_a$ | — |
| " | Backwards-upwards | 12 | 20A | $n_a$ | 21A |
| " | Backwards-downwards | 13 | 20A | $n_a$ | 21A |
| Dessert spoon | Forwards-upwards | 20 | 20B | $n_b$ | — |
| " | Forwards-downwards | 21 | 20B | $n_b$ | — |
| " | Backwards-upwards | 22 | 20B | $n_b$ | 21B |
| " | Backwards-downwards | 23 | 20B | $n_b$ | 21B |
| Fork | Forwards-upwards | 30 | 20C | $n_c$ | — |
| " | Forwards-downwards | 31 | 20C | $n_c$ | — |
| " | Backwards-upwards | 32 | 20C | $n_c$ | 21C |
| " | Backwards-downwards | 33 | 20C | $n_c$ | 21C |
| Knife | Forwards-upwards | 40 | 20D | $n_d$ | — |
| " | Forwards-downwards | 41 | 20D | $n_d$ | — |
| " | Backwards-upwards | 42 | 20D | $n_d$ | 21D |
| " | Backwards-downwards | 43 | 20D | $n_d$ | 21D |

Certain fault codes are also to be found tabulated in the main memory, which can be read off in the display panel 71. The light diodes 72 on the manoeuvre unit 7 can be used to check to opto section byte by byte if required. The light diodes 72 are also used in the known manner in the trimming of the photo-transistors 33 and 62*a–h* with the aid of the potentiometers 47 and 63 respectively, FIG. 5 and FIG. 6.

Detection and sorting

In the detection of objects the read-off unit 3 works in a manner which is in principle the same as in the above described programming. The contour opto section of the object, the number of opto sections and certain height profiles are read off by the contour 30 and the height 31 in precisely the same manner as in the programming. The shifted contour opto section words are stored in the read-in memory. In this memory the second and third opto section words are selected and also the third and the second from the end and are fed in together with the sum of all contour opto section words and the number of contour opto sections to a computing memory in the microcomputer 6 according to the programme. These data constitute the signalisation of the object which is registered by the opto unit 14.

The signalisation fed into the computing memory is compared with all the memory blocks in the main memory. With agreement between the signalisation in the computing memory and any of the signalisations with tolerance set in the main memory the code is obtained for the present object in the present situation. The code is stored till further notice.

In and with the conclusion of the detection and scanning of the cutlery's signalisation, the code is now scanned with reference to a previously programmed table which like table 1 includes the various codes, information about corresponding flaps and switchpoints, and sync pulses corresponding to the flaps, which in their turn constitute a measure of the distance from the contour opto to the flap in question. When the code sought is encountered in the table, the number of sync pulses, representing the distance to the flap 20A–D which will direct the object downwards from the belt 12, is obtained. A free countdown is activated and provided with the number of sync pulses that was obtained from the table. These operations are carried out in a time that is negligible in relation to the speed of the conveyor belt.

The countdown starts immediately and decreases, i.e. counts down one unit for each sync pulse. When zero is reached, an interrupt is obtained, i.e. a command for activation of the present flap 20A, 20B, 20C or 20D. The cutlery has then been fed forwards on the belt 12 to this flap, which is moved by the corresponding electromagnet 22A, 22B, 22C or 22D. The flap lies drawn across for a certain time, which is determined by the programme ware or by the microcomputer's hardware. Subsequently the flap goes back to the normal position. This is illustrated graphically in row XII in FIG. 7.

When any of the flaps 20A–D turns, the same code is scanned again in an analogously formed table in the main memory. In this table every second code corresponds to one of the switchpoints 21A–D, while the remaining codes do not have any corresponding switchpoint. In our case the codes 12, 13 have a corresponding switchpoint 21A, the codes 22, 23 the switchpoint 21B, the codes 32, 33 the switchpoint 21C and the codes 42, 43 the switchpoint 21D. This second table also contains information about the required number of sync pulses that must elapse before the switchpoint is moved after the flap has been moved. This also becomes clear from the pulse diagram, row XIII, FIG. 7. When this number of pulses has elapsed, the switchpoint moves during a certain predetermined time and guides the cutlery so that it turns before it lands in the intended box 24A–D.

The calculator is free for new settting when as many sync pulses have elapsed as are prescribed in the programme, before the switchpoint in the present case is to be moved. In the system there is normally a sufficient number of countdown units for a free, i.e. not activated, countdown unit always to be accessible for objects which have been detected and which are being fed forwards on belt 12.

Pieces of cutlery which are fed forwards on the belt 12 must lie at a certain minimum distance from each other for the mechanical sorting element, i.e. in the first instance flaps and switchpoints, to work without any problems. This minimum distance expressed to sync pulses is also to be found stored in the main memory. If the distance is too little, the reject flap 19 is moved through activation of the electro-magnet 19A and guides the object to the box 8. If two or more pieces of cutlery overlap each other on the belt 12, this is registered by the contour opto as a very long object with special contours, whose signalisation is not found in any memory block in the main memory. In this case too the reject flap 19 is moved and guides the two objects away to the box 8. The same thing happens if an unidentified object passes the read-off unit 3.

On the display panel 71 you can read off why the reject flap 19 has been activated. A certain selected letter combination signifies that the signalisation read off did not accord with any signalisation with tolerance set in the main memory, which in its turn can have several causes. It can for example be a question of some object that should not belong to the assortment in box 8 having passed, two or more objects overlapping each other on the belt 12, or one or more photo-transistors having been covered by particles or the like etc. Another selected letter combination on the display panel 71 means that all countdown units were occupied (a question of dimensioning). A third letter combination means that the pieces of cutlery came too close after each other on the belt 12, and a fourth letter combination means that the cutlery was too long with regard to the distance between two flaps 20A–D following each other.

We claim:

1. Device for sorting unsorted cutlery into sorted cutlery, comprising a. a feed-in unit comprising a container into which the unsorted cutlery pieces can be poured and first means for feeding the cutlery unsorted out of the container;

b. a separating unit having second means for separating the pieces of cutlery from the feed-in unit from each other and arranging the pieces in sequence behind one another;

c. a read-off unit including a moving conveyor belt to which the separating unit delivers the pieces of cutlery in sequence one after the other, a pulsator and an optical unit, with the conveyor belt having a width which is considerably less than the length of the cutlery, the pulsator emitting pulses at a tempo related to the belt speed, and the optical unit including a light source and opto-electronic means for determining the contour of the cutlery;

d. a sorting unit including sorting third means for bringing each piece of cutlery to a receiving container intended for that type of cutlery.

e. a return unit fourth means for separating from the sorting device cutlery which has been insufficiently identified, or for returning to the feed-in units such unidentified cutlery;

f. A maneuver unit which is coupled to a computer means and provided with maneuver means for control of the computer means, said computer means being linked with the maneuver unit, the pulsator, the opto-electronic means and the sorting unit, said computer means for registering signalizations of the readoff contours of the cutlery, for comparing these signalizations with programmed signalizations, and for influencing the appropriate sorting third means in the sorting unit according to the outcome of the comparisons.

2. Device as per claim 1 characterised by the fact that the feed-in unit (1) comprises a sloping conveyor belt (9) with the aid of which the cutlery is fed upwards out of the container (8) and a means for rough separations of the cutlery in the transverse direction on the aforesaid conveyor belt (9).

3. Device as per claim 2, characterised by the fact that the said first means comprise a rotating brush.

4. Device as per claim 1, characterised by the fact that the separating unit (2) comprises at least two separation means (10, 11) positioned one after the other with the aid of which the cutlery is fed forwards in a longitudinal direction.

5. Device as per claim 4, characterised by the fact that the separation means positioned one after the other are constituted by conveyor belts (10, 11) which are driven at different speeds, contributing to causing the pieces of cutlery to be separated from each other.

6. Device as per claim 1, characterised by the fact that the read-off unit (3) comprises opto-electronic recognition and identification means with the aforementioned optical unit (14) and electronic devices for transformation of the optically recognised information about the shape fo the cutlery into a signalisation comprising selected digital information, and that the computer unit (6) has a memory organ which can store signalisations in the form of corresponding selected information about all the pieces of cutlery occuring in the assortment and the main orientations which the cutlery can adopt on the conveyor belt of the read-off unit for comparison with the signalisations obtained in the scanning.

7. Device as per claim 1, characterised by first recognition means comprising a first bar (40), positioned under the path of movement of the cutlery, of light-recognising organs for recognition of the contour of the cutlery lying on the conveyor belt and second recognition means comprising a second bar (**62*a–h***), positioned at the side of the path of movement of the cutlery, of light-recognising means for recognition of the height profile of the cutlery.

8. Device as per claim 7, characterised by the fact that the said first bar is disposed in the area of a loop in the conveyor belt in the read-off unit.

9. Device as per claim 7, characterised by the fact that a moment of time that is related to the speed of the conveyor belt positioned in the read-off unit the light-recognising means in the said first bar are arranged to be recognised, that means are provided for communicating a stanstill of activation for at least certain selected moments of time, representing a corresponding number of optical sections of the object, to the computer unit (6) in the form of binary words, which each represent the extent of the piece of cutlery in the present section and which together with any further data form the digital signalisation of the piece of cutlery.

10. Device as per claim 9, characterised by the fact that the binary words are shifted till the first figure in the number is a logic one before the binary word so formed is transferred to a computing memory in the computer unit.

11. Device as per any of the claims 2–10 or 1, characterised by the fact that for each type of cutlery at least two signalisations are stored in the computer's memory unit, namely at least one signalisation for cutlery lying frontways and at least one signalistion for cutlery lying backwards on the conveyor belt in the read-off (3), and that the sorting means in the sorting unit (4) comprise flaps (**20*a–d*) arranged to remove identified cutlery from the conveyor belt and also switchpoints (21*a–d*) arranged between the flaps and the cutlery receivers (8) in order to guide certain pieces of cutlery so that all cutlery is facing the same way in the receiving boxes (8**).

* * * * *